US005613873A

United States Patent [19]

Bell, Jr.

[11] Patent Number: 5,613,873

[45] Date of Patent: Mar. 25, 1997

[54] MODULAR JACK WITH INTEGRAL LIGHT-EMITTING DIODE

[75] Inventor: Joseph W. Bell, Jr., Austin, Tex.

[73] Assignee: Dell USA, L.P., Austin, Tex.

[21] Appl. No.: 180,489

[22] Filed: Dec. 16, 1993

[51] Int. Cl.[6] ..... H01R 13/00

[52] U.S. Cl. ..... 439/490; 439/910

[58] Field of Search ..... 439/488–490, 439/676, 55, 56, 910, 709

[56] References Cited

U.S. PATENT DOCUMENTS

| | | | |
|---|---|---|---|
| 4,379,606 | 4/1983 | Clark et al. | 439/490 |
| 4,924,213 | 5/1990 | Decho et al. | 439/709 |
| 4,978,317 | 12/1990 | Pocrass | 439/490 |
| 5,222,164 | 6/1993 | Bass, Sr. et al. | 439/488 |
| 5,244,409 | 9/1993 | Guss, III et al. | 439/490 |
| 5,320,560 | 6/1994 | Fladung | 439/490 |

*Primary Examiner*—Hien Vu

*Attorney, Agent, or Firm*—Haynes and Boone, L.L.P.

[57] ABSTRACT

A modular jack for a 10BASE-T standard Ethernet-type local area network connection to a printed circuit board edge includes a body portion, a plug receptacle, a PC board mounting apparatus, and a cavity for receiving a LED to indicate the status of the LAN connection. The LED preferably is embedded in the front face of the body portion of the jack. Alternatively, the body portion of the jack may be molded from a transparent or a translucent resin, and the cavity may be formed in the underside of the body portion, whereby the LED may be mounted on the PC board and the jack inserted on the PC board over the LED, with the body portion of the jack conducting light from the LED to the front face of the jask.

3 Claims, 3 Drawing Sheets

MODULAR JACK WITH INTEGRAL LIGHT-EMITTING DIODE

BACKGROUND OF THE INVENTION

The present invention relates generally to cable connectors used in a local area network, and more particularly to connectors for a 10BASE-T standard Ethernet-type network that requires a light-emitting diode to indicate the status of the connection. Still more particularly, the present invention relates to a telephone-type modular jack that has been improved to include a light-emitting diode within the body of the jack.

More than one-half of the local area networks ("LANs") in the United States employ the 10BASE-T standard for Ethernet-type LANs operating under the IEEE 803.2 protocol. The 10BASE-T standard LAN transmits over low-cost, voice-grade, unshielded twisted pair cabling. It connects using standard telephone technology with convenient telephone-type plugs, designated "RJ45" in the industry, at the office wall and at the back panel of the computer.

The 10BASE-T standard requires a light-emitting diode ("LED") to display the status of the LAN connection ("link status") and provides for several optional LEDs to display polarity and other transmission information.

The highly competitive market for ever smaller personal computers having increasingly greater processing capabilities drives computer manufacturers to design computers with a greater number of features and to consolidate these features, where possible, on the computer's motherboard. The edge of the motherboard, however, typically is crowded, and there is not sufficient linear space along the edge for the addition of a RJ45 connector and a LED, as required by the popular 10BASE-T standard.

Hence, it would be advantageous to devise a 10BASE-T Ethernet-type LAN connection that does not require the linear space of an RJ45 modular jack adjacent to a LED, so that the LAN interface can more easily be added directly to the motherboard.

SUMMARY OF THE INVENTION

Accordingly, there is provided herein a modular jack for connecting a LAN cable terminated with a plug to a printed circuit board, including a body portion, a receptacle for receiving the plug, mounting apparatus for affixing the body portion on the printed circuit board, and a cavity within the body for receiving a LED to display the presence and absence of an active LAN connection. The cavity may be a recess formed in the front face of the body portion, whereby the EED is visible from the front of the jack. Alternatively, the body portion may be formed of a transparent or translucent plastic material, and the cavity may be a recess formed in the bottom face of the body, portion, whereby the LED may be installed on the printed circuit board, with the jack installed over the LED and conducting light from the LED to the front face of the jack.

An apparatus made in accordance with the principles of the present invention is relatively simple to construct and install and consolidates the printed circuit board edge space required for the LED into the spase utilized by the modular jack, thereby facilitating incorporation of the 10BASE-T LAN interface onto the motherboard. These and other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference will now be made to the accompanying drawings, wherein.

DESCRIPTION OF THE PREFERRED EMBODIMENT

The limited edge space available on the motherboard of current personal computers makes it difficult to incorporate a 10BASE-T Ethernet-type local area network ("LAN") connection onto the motherboard. ALAN operating according to the popular 10BASE-T standard includes a RJ45 telephone type modular jack and a light-emitting diode ("LED") to indicate the status of the LAN connection. In accordance with the principles of the present invention, an improved modular jack includes a LED incorporated into the body of the jack, whereby the edge space required for the 10BASE-T LAN connection is minimized.

Figure 1:
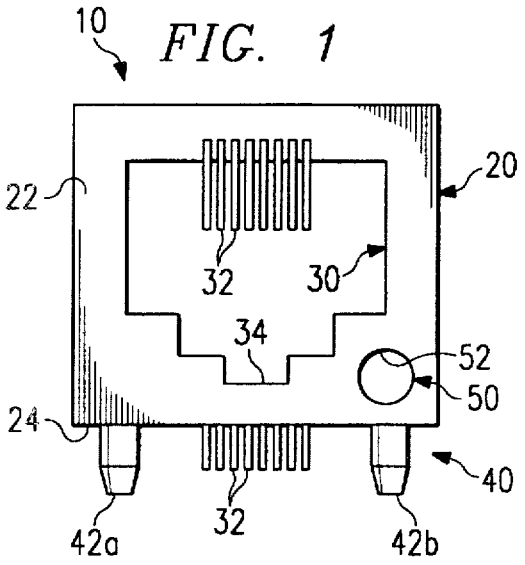
FIG. 1 is a front elevation of the preferred embodiment of a modular jack constructed in accordance with the principles of the present invention.
Figure 3:
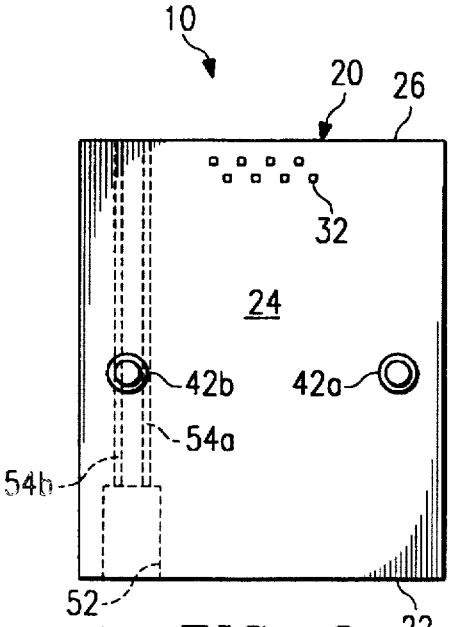
FIG. 3 is a bottom elevation of the modular jack depicted in FIG. 1.
Figure 4:
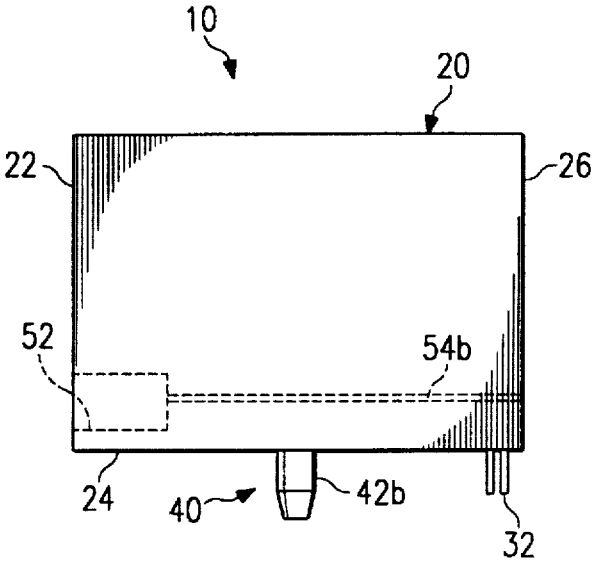
FIG. 4 is a side elevation of the modular jack depicted in FIGS. 1 and 3.

Referring now to FIGS. 1, 3, and 4, a modular jack 10 constructed in accordance with the principles of the present invention includes a body portion 20, a plug receptacle 30, a mounting apparatus 40, and a cavity 50 for receiving a LED.

The body portion 20 preferably is injection molded of a plastic material in a generally block-shaped configuration as depicted in FIGS. 1, 3, and 4; however, the particular configuration of the body portion 20 is not critical to the operation of the present invention. The body portion 20 may have any desirable configuration so long as it incorporates the elements of the invention as described herein. Those having skill in the art are readily familiar with the molding techniques and materials commonly used at present to manufacture telephone-type :connectors similar to those described herein.

Pertinent to aspects of the present invention, the body portion 20 includes a front face 22, a bottom face 24, and a back face 26.

Referring still to FIGS. 1, 3, and 4, the plug receptacle 30 comprises an opening in the front face 22 of the body portion 20 into which a plug on an end of a cable (not shown) is received. The receptacle 30 is a standard telephone-type receptacle normally included on a RJ45 modular jack, including a plurality of electrical contacts 32 and a groove 34. The electrical contacts 32 are positioned within the receptacle 30 so as to engage corresponding contacts on the plug (not shown) when the plug is positioned within the receptacle 30. The contacts 32 extend within the receptacle 30 and through the bottom face 24 of the body portion 20, as indicated most clearly in FIG. 3, for engagement typically by solder connection with a printed circuit ("PC") board (not shown). The groove 34 cooperates with a flexible extension on the plug (not shown) to releasably secure the plug within the receptacle.

The mounting apparatus 40 comprises the means by which the body portion 20 is attached to a PC board (not shown). The mounting apparatus 40 preferably comprises a pair of legs 42*a, b* extending downward generally normally from the bottom face 24 of the body portion 20. The legs 42*a, b* are friction-fitted into corresponding openings in a PC board (not shown) to retain the body portion 20 against the PC board. Alternatively, the mounting apparatus 40 may be any apparatus currently in use on existing board-mounted RJ45 modular jacks to secure the jack to a PC board.

Figure 2:
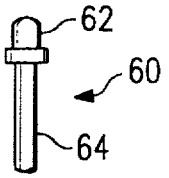
FIG. 2 is a side elevation of a through-hole light-emitting diode such as may be used in connection with the jack depicted in FIG. 1.

Referring now to FIGS. 1–4, the cavity 50 comprises a recess 52 in the front face 22 of the body portion 20 and a pair of passageways 54*a, b*. The recess 52 is a generally cylinder-shaped opening in the front face 22 of the body portion 20 sized so as to receive therein the light-emitting portion 62 of a through-hole LED 60 (FIG. 2). The passageways 54*a, b* extend from the recess 52 to the back face 26 of the body portion 20 to conduct the electrical leads 64 of the LED 60 to a point at which they may be angled downward for connection to a PC board (not shown). Alternatively, the passaging ways 54*a, b* may extend arcuately from the recess 52 to the bottom face 24 of the body portion 20 to exit the body portion in close proximity to the PC board. As an alternative to the use of a pair of passageways 54*a, b*, the passageways 54*a, b* may comprise a single passageway through which a pair of insulated LED electrical leads 64 extend.

Figure 5:
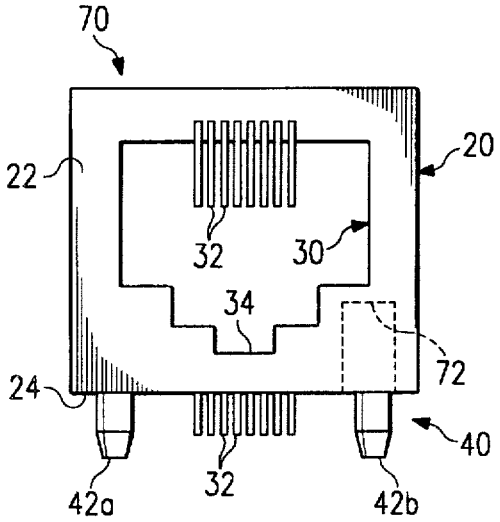
FIG. 5 is a front elevation of a first alternative embodiment of a modular jack constructed in accordance with the principles of the present invention.
Figure 6:
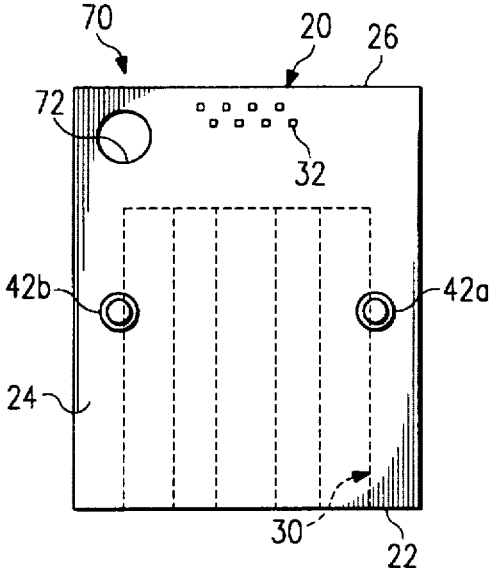
FIG. 6 is a bottom elevation of the modular jack depicted in FIG. 5.
Figure 7:
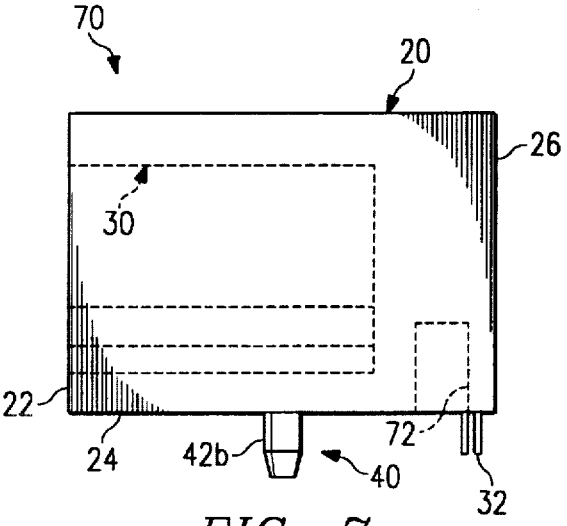
FIG. 7 is a side elevation of the modular jack depicted in FIGS. 5 and 6.
Figure 8:
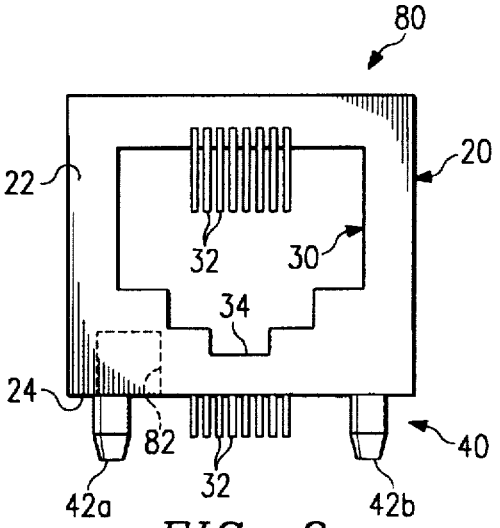
FIG. 8 is a front elevation of a second alternative embodiment of a modular jack constructed in accordance with the principles of the present invention.

Referring now to FIGS. 5–7, a first alternative embodiment of the modular jack 70 constructed in accordance with the principles of the present invention includes a body portion, a plug receptacle, and a mounting apparatus as described in connection with the preferred embodiment depicted in FIGS. 1, 3, and 4, and a cavity 72 for receiving a LED. For ease of understanding, reference characters used in connection with the description of the preferred embodiment will be used also for the same apparatus or features in this and the succeeding alternative embodiments.

The body portion 20 of the modular jack 70 preferably is molded of a transparent or translucent plastic resin that will conduct light between the cavity 72 and the front face 22 of the body portion 20 of the jack 70.

The cavity 72 comprises a generally cylinder-shaped opening in the bottom face 24 of the body portion 20, positioned between the receptacle 30 and the back face 26 of the body portion 20. The cavity 72 is sized so as to receive the light-emitting portion 62 of a through-hole LED 60 (FIG. 2). The LED preferably is mounted on a PC board (not shown) in conventional fashion, and then the modular jack 70 is mounted on the PC board over the LED, with the light-emitting portion thereof extending within the cavity 72. The transparent (or translucent) body portion 20 conducts light from the illuminated LED to the front face 22 of the body portion 20, giving an indication of the status of the LAN connection.

Referring now to FIGS. 8–11, a second alternative embodiment of the modular jack 80 constructed in accordance with the principles of the present invention includes a body portion, a plug receptacle, and a :mounting apparatus as described in connection with the preferred embodiment depicted in FIGS. 1, 3, and 4, and a cavity 82 for receiving a LED, The body portion 20 of the modular jack 80 preferably is molded from a transparent or translucent plastic resin that will conduct light between the cavity 82 and the front face 22 of the body portion 20 of the jack 80.

Figure 9:
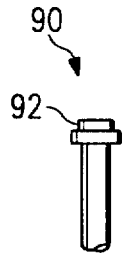
FIG. 9 is a side elevation of a surface-mount light-emitting diode such as may be used in connection with the jack depicted in FIG. 8.
Figure 10:
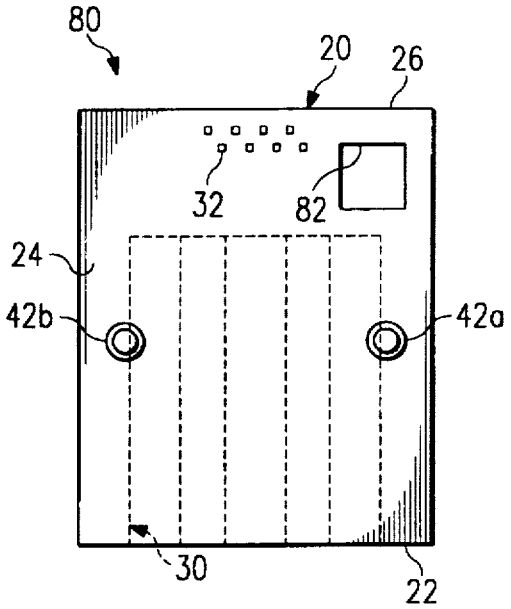
FIG. 10 is a bottom elevation of the modular jack depicted in FIG. 8.
Figure 11:
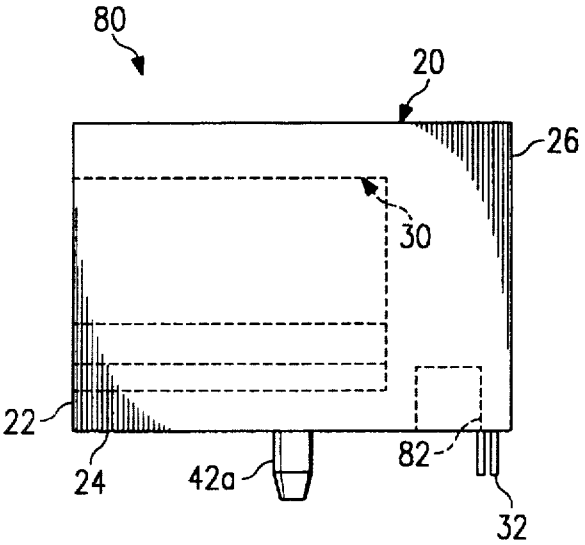
FIG. 11 is a side elevation of the modular jack depicted in FIGS. 8 and 10.

The cavity 82 comprises a generally square-shaped opening in the bottom face 24 of the body portion 20, positioned between the receptacle 30 and the back face 26 of the body portion 20. The cavity 82 is sized so as to receive the light-emitting portion 92 of a surface-mounted LED 90 (FIG. 9). The LED preferably is mounted on a PC board (not shown) in conventional fashion, and then the modular jack 80 is mounted on the PC board over the LED 90, with the light-emitting portion 92 extending within the cavity 82. The transparent (or translucent) body portion 20 conducts light from the illuminated LED 90 to the front face 22 of the body portion 20, giving an indication of the status of the LAN connection.

Figure 12:
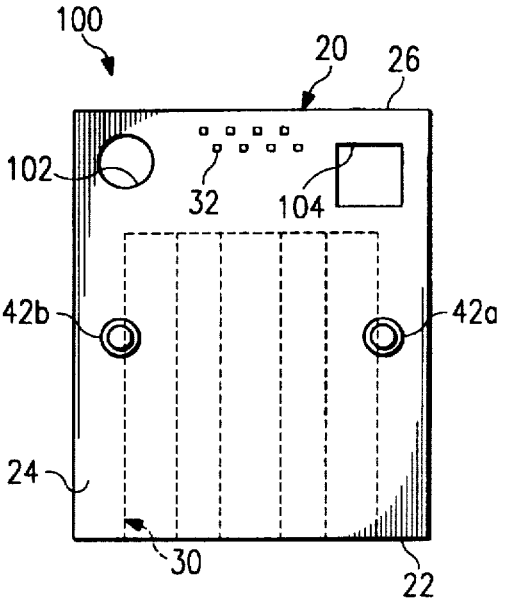
FIG. 12 is a bottom elevation of a third alternative embodiment of a modular jack constructed in accordance with the principles of the present invention.

Referring now to FIG. 12, a third alternative embodiment of the modular jack 100 constructed in accordance with the principles of the present invention includes a body portion, a plug receptacle, and a mounting apparatus as described in connection with the preferred embodiment depicted in FIGS. 1, 3, and 4, and a pair of cavities 102, 104 for receiving a LED.

The body portion 20 of the modular jack 100 preferably is molded from a transparent or translucent plastic resin that will conduct light between the cavity 102, 104 and the front face 22 of the body portion 20 of the jack 100.

The cavity 102 comprises a generally cylinder-shaped opening in the bottom face 24 of the body portion 20, positioned between the receptacle 30 and the back face 26 of the body portion 20. The cavity 102 is sized so as to receive the light-emitting portion 62 of a through-hole LED 60 (FIG. 2). The cavity 104 comprises a generally square-shaped opening in the bottom face 24 of the body portion 20, positioned between the receptacle 30 and the back face 26 of the body portion 20. The cavity 104 is sized so as to receive the light-emitting portion 92 of a surface-mounted LED 90 (FIG. 9). The inclusion of a pair of cavities 102, 104 enables the same jack 100 to accommodate either a through-hole LED or a surface-mounted LED, according to the preference of the designer, or enables the simultaneous use of two LEDs.

The LED (or LEDs if two are to be used) preferably is mounted on a PC board (not shown) in conventional fashion, and then the modular jack 100 is mounted on the PC board over the LED, with the light-emitting portion thereof extending within the cavity 102, 104. The transparent (or translucent) body portion 20 conducts light from the illuminated LED to the front face 22 of the body portion 20, giving an indication of the status of the LAN connection.

One having skill in the art will appreciate that the foregoing description of attributes and advantages to be experienced in constructing the apparatus described herein is not exhaustive of all features of the present invention. It will be appreciated that modifications for the aforedescribed preferred embodiment and alternative embodiments of the invention can be made without departing in substance from the principles of the invention.

What is claimed is:

1. A jack for connecting a cable terminated with a plug to a printed circuit board, comprising:

a body portion having a front face, a back face and a bottom face;

a receptacle for receiving the plug;

mounting apparatus for affixing said body portion on the printed circuit board;

a first cavity within said body portion for receiving a first LED;

a second cavity within said body portion for receiving a second LED;

wherein said body portion is formed of a transparent or translucent material, and wherein said first cavity comprises a recess having a generally rectangular cross section formed in the bottom face of said body portion in a location adjacent to said back faces for receiving a light-emitting portion of the first LED, and wherein said second cavity comprises a recess having a generally circular cross section formed in the bottom face of said body portion in a location adjacent to said back face for receiving a light-emitting portion of the second LED, whereby the LEDs may be mounted on the printed circuit board and said jack may be mounted on the printed circuit board over the LEDs, with the light emitting portions of the LEDs extending into said respective recesses such that the light-emitting portions thereof are completely surrounded by the body portion and the printed circuit board, so that when the LEDs are emitting light, the transparent or translucent material conducts light from the LEDs to the front face of said body portion.

2. A modular jack for connecting a LAN cable terminated with a plug to a printed circuit board, comprising:

a body portion having a front face a back face and a bottom face;

a receptacle formed in the front face of said body portion for receiving the plug, said receptacle including a plurality of electrical contacts for connection to a corresponding plurality of electrical contacts on the plug;

mounting apparatus on the bottom face of said body portion for affixing said body portion on the printed circuit board;

a first cavity within said body portion for receiving a first LED to indicate the presence and absences of an active LAN connection to the printed circuit board;

a second cavity within said body portion for receiving a second LED;

wherein said body portion is formed of a transparent or translucent plastic material, and wherein said first cavity comprises a recess having a generally rectangular cross section formed in the bottom face of said body portion in a location adjacent to said back face for receiving al light-emitting portion of the first LEDS and wherein said second cavity comprises a recess having a generally circular cross section formed in the bottom face of said body portion in a location adjacent to a said back face for receiving a light-emitting portion of the second LED, whereby the LEDs may be mounted on the printed circuit board and said jack may be removably mounted on the printed circuit board over the LEDs, with the light-emitting portions of the LEDs extending into said respective recesses, whereby, when the jack is mounted, the light-emitting portions are completely surrounded by the body portion and the printed circuit board and said body portion may conduct light from LEDs through the transparent or translucent material to the front face of said body portion.

3. A RJ45 modular jack for use in a local area network operating on the 10BASE-T Ethernet standard to connect a network cable terminated with a telephone-type plug to a printed circuit board, comprising:

a body portion having a front face a back face and a bottom face, said body portion being formed of a transparent or translucent material;

a receptacle formed in the front face of said body portion for receiving the plug, said receptacle including apparatus for releasably engaging the plug;

a plurality of electrical contacts extending within said receptacle and through the bottom face of said body portion for attachment to the printed circuit board;

a pair of pedestals extending from the bottom face of said body portion for friction engagement within corresponding holes in the printed circuit board; and a first cavity within said body portion for receiving a light-emitting portion of a first LED to indicate the presence and absence of an active local area network connection to the printed circuit board; and a second cavity within said body portion for receiving a light-emitting portion of a second LED;

wherein said first cavity includes a recess having a generally rectangular cross section formed in the bottom face of said body portion in a location near said back face for receiving a light-emitting portion of the first LED, and said second cavity includes a recess having a generally circular cross section formed in the bottom face of said body portion in a location near said back face for receiving a light-emitting portion of the second LED, whereby the LEDs may be mounted on the printed circuit board and said jack may be mounted on the printed circuit board over LEDs, with the light-emitting portions of the LEDs extending into said respective recesses such that the light-emitting portions are completely surrounded by the body portion and the printed circuit board, enabling said body portions to conduct light from the LEDs through the transparent or translucent.

* * * * *

UNITED STATES PATENT AND TRADEMARK OFFICE

CERTIFICATE OF CORRECTION

PATENT NO. : 5,613,873

DATED : March 25, 1997

INVENTOR(S) : Joseph W. Bell, Jr.

It is certified that error appears in the above-indentified patent and that said Letters Patent is hereby corrected as shown below:

In the Abstract, final line, "jask" should be --jack--.

Column 1, line 53, "EED" should be --LED--.

Column 1, line 63, "spase" should be --space--.

Column 2, line 48, "ALAN" should be --A LAN--.

Column 3, line 3, ":connectors" should be --connectors--.

Signed and Sealed this

Second Day of September, 1997

*Attest:*

*Attesting Officer*

BRUCE LEHMAN

*Commissioner of Patents and Trademarks*